US007810583B2

(12) United States Patent
Ruggier et al.

(10) Patent No.: US 7,810,583 B2
(45) Date of Patent: Oct. 12, 2010

(54) DRILLING SYSTEMS AND METHODS

(75) Inventors: Michael Ruggier, Blairs Abderdeen (GB); Robert Nicholas Worrall, Basel (CH)

(73) Assignee: Shell Oil Company, Houston, TX (US)

( * ) Notice: Subject to any disclaimer, the term of this patent is extended or adjusted under 35 U.S.C. 154(b) by 10 days.

(21) Appl. No.: 12/296,141

(22) PCT Filed: Apr. 4, 2007

(86) PCT No.: PCT/US2007/065931

§ 371 (c)(1),
(2), (4) Date: Jan. 20, 2009

(87) PCT Pub. No.: WO2007/118110

PCT Pub. Date: Oct. 18, 2007

(65) Prior Publication Data

US 2009/0145662 A1 Jun. 11, 2009

Related U.S. Application Data

(60) Provisional application No. 60/789,512, filed on Apr. 5, 2006.

(51) Int. Cl.
*E21B 7/28* (2006.01)

(52) U.S. Cl. ..... 175/57; 175/7; 175/324

(58) Field of Classification Search ..... 175/57, 175/324, 7

See application file for complete search history.

(56) References Cited

U.S. PATENT DOCUMENTS

| | | | | |
|---|---|---|---|---|
| 2,028,407 | A | 1/1936 | Moleau | 103/117 |
| 2,306,118 | A | 12/1942 | Graham | 255/69 |
| 4,049,066 | A | 9/1977 | Richey | 175/323 |
| 4,368,787 | A | 1/1983 | Messenger | 175/319 |
| 4,630,691 | A * | 12/1986 | Hooper | 175/65 |
| 4,744,426 | A | 5/1988 | Reed | 175/102 |
| 4,823,891 | A | 4/1989 | Hommani et al. | 175/323 |
| 5,171,139 | A | 12/1992 | Underwood et al. | 418/48 |
| 6,896,075 | B2 | 5/2005 | Haugen et al. | 175/57 |

* cited by examiner

*Primary Examiner*—Hoang Dang
(74) *Attorney, Agent, or Firm*—William E. Hickman

(57) ABSTRACT

A drilling system comprising a pipe comprising a first end and a second end; a drill bit near a first end of the pipe, adapted to drill a hole in a formation; a pipe rotator near a second end of the pipe adapted to rotate the pipe; and a pump connected to the pipe between the first end and the second end, the pump adapted to transport a fluid from the first end of the pipe to the second end of the pipe, the pump comprising a first portion adapted to rotate with the pipe and a second portion adapted to remain stationary relative to the pipe.

15 Claims, 7 Drawing Sheets turbine with impellers add centrifugal &
pistons w/ valves turbine with impellers add centrifugal &
pistons w/ valves

DRILLING SYSTEMS AND METHODS

RELATED APPLICATIONS

This application claims priority to U.S. Provisional Application 60/789,512, filed on Apr. 5, 2006, and having U.S. Provisional Application 60/789,512 is herein incorporated by reference in its entirety.

FIELD OF THE INVENTION

The present disclosure relates to drilling systems and methods. In particular, the present disclosure relates to reverse circulation drilling systems and methods.

BACKGROUND OF THE INVENTION

When drilling a hole, drilling fluid or mud may be used to carry away cuttings, lubricate the bit, cool the bit, provide pressure control, and/or for other purposes as are known in the art. Drilling fluid or mud used in drilling of wellbores may be a mixture of water, clay, weighting material, and a few chemicals. Sometimes oil may be used instead of water, or a little oil is added to the water to give the mud certain desirable properties. Clay may be added to the mud so that it can keep the bit cuttings in suspension as they move up the hole. The clay may also sheath the wall of the hole. This thin veneer of clay is termed wall cake, and makes the hole stable so it will not cave in or slough.

The equipment in a typical drilling fluid circulating system may include a mud pump which takes in mud from the mud pits and sends it out a discharge line to a standpipe. The standpipe is a steel pipe mounted vertically on one leg of the mast or derrick. The mud is pumped up the standpipe and into a flexible, very strong, reinforced rubber hose called the rotary hose, or kelly hose. The rotary hose is connected to the swivel. The mud enters the swivel, flows down the kelly, drill pipe, and drill collars, and exists at the bit. It then flows with a sharp U-turn and heads back up the hole in the annulus which is the space between the outside of the drill string and wall of the hole. Finally, the mud leaves the hole through a steel pipe called the mud-return line and falls over a vibrating, screenlike device called the shale shaker. The shaker screens out the cuttings and dumps them into one of the reserve pits (the earthen pits excavated when the site was being prepared). The mud may be circulated over and over again throughout the drilling of the well.

Under some circumstances, it may be desirable to have a reverse circulation of drilling fluid, in which the fluid flows in a reverse manner to that described above, namely down the annulus and up the drill string. For example, reverse circulation may provide for an increased return velocity of the cuttings in the drill string, which could allow for a lower viscosity mud to achieve cuttings return; reverse circulation may provide for a better mechanism to sample the cuttings and/or mud from downhole; and/or reverse circulation may provide for a better mechanism for controlling downhole pressure.

U.S. Pat. No. 4,368,787 discloses an arrangement for drilling deviated wellbores, such as in extended reach drilling, which is particularly designed to reduce the chance of pressure-differential sticking of the drill string by removing the drilling cuttings from the wellbore bottom by reverse circulation of the drilling fluid using a pump powered by the cones of the rotary bit. The drill string is turned by a rotary, and as the drill string turns, the cones turn as they are rolled on the bottom of the hole. A power drive is taken off the bit cones, and powers a pump which pumps mud from the annulus, around and through the bit, and up the drill pipe. In this way, troublesome cuttings are kept out of the annulus, and the cuttings are more effectively removed by pumping up and out the drill pipe. U.S. Pat. No. 4,368,787 is herein incorporated by reference in its entirety.

There is a need in the art for improved systems and methods for reverse circulation drilling systems and methods. There is a need in the art for improved pumping systems to be used in reverse circulation drilling systems. There is a need in the art for higher volume pumping systems to be used in reverse circulation drilling systems. There is a need in the art for improved drill bit cleaning to be used in reverse circulation drilling systems.

SUMMARY OF THE INVENTION

In one aspect, the invention provides a drilling system comprising a pipe comprising a first end and a second end; a drill bit near a first end of the pipe, adapted to drill a hole in a formation; a pipe rotator near a second end of the pipe adapted to rotate the pipe; and a pump connected to the pipe between the first end and the second end, the pump adapted to transport a fluid from the first end of the pipe to the second end of the pipe, the pump comprising a first portion adapted to rotate with the pipe and a second portion adapted to remain stationary relative to the pipe.

In another aspect, the invention provides a method of enlarging a hole, comprising mounting a drill bit to a pipe; placing the drill bit and the pipe in the hole; rotating the pipe and drill bit in the hole to enlarge the hole; placing a fluid in an annulus between the hole and the pipe; rotating a portion of a pump with the rotating pipe; and pumping the fluid through the drill bit and through the pipe with the pump.

Advantages of the invention include one or more of the following:

Improved systems and methods for reverse circulation drilling.

Improved systems and methods for pumping systems to be used in reverse circulation drilling systems.

Improved systems and methods for higher volume pumping systems to be used in reverse circulation drilling systems.

Improved systems and methods for drill bit cleaning to be used in reverse circulation drilling systems.

DETAILED DESCRIPTION

Figure 1:
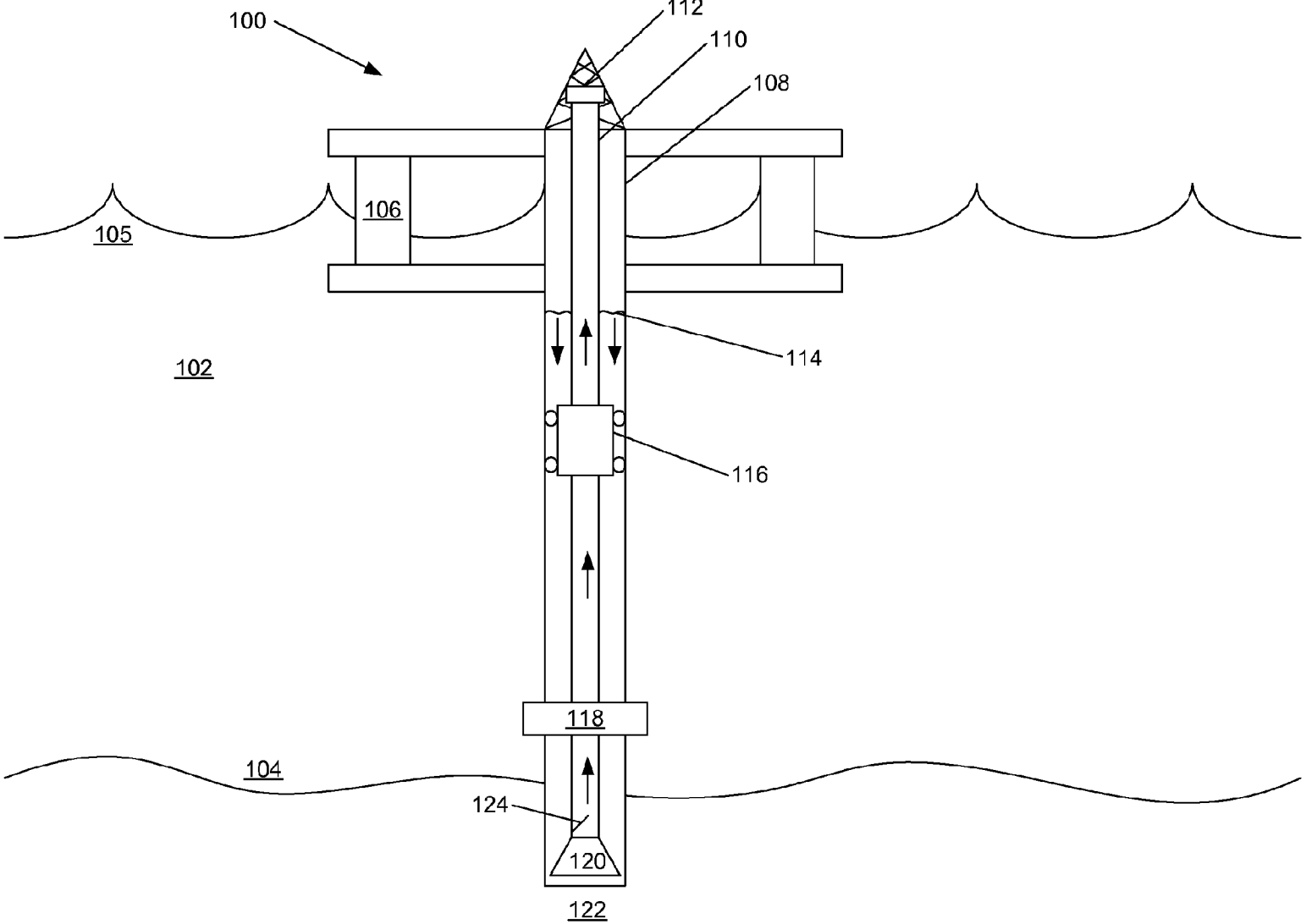
FIG. 1 illustrates a reverse circulation drilling system.

Referring now to FIG. 1, in one embodiment of the invention, there is illustrated a drilling system 100. The drilling system is in a body of water 102 having a bottom 104 and a top 105. The drilling system includes a vessel 106, which is attached to an outer pipe 108 and an inner pipe 110. Inner pipe rotator 112 is adapted to rotate the inner pipe relative to the outer pipe. A fluid is within the annulus between inner pipe 110 and outer pipe 108, and has annulus fluid level 114. Fluid flows down the annulus as shown by the arrows and returns up the inner pipe 110, also as shown by arrows. A pump 116 is adapted to transport fluid up the inner pipe 110. A shut-off/ disconnect 118 may be provided near the bottom 104. Drill bit 120 is located near the bottom of the inner pipe 110 and is adapted to drill into the formation 122.

In operation, inner pipe 110 rotates, which rotates drill bit 120, in order to drill a hole through formation 122. A fluid is fed through the annulus between the inner pipe 110 and the outer pipe 108, and flows down towards the drill bit 120 and is adapted to carry away the cuttings from the formation 122 back up through the inner pipe 110. The pump 116 is adapted to advance the fluid and the cuttings through the inner pipe 110 back towards the vessel 106.

In some embodiments, pump 116 may be located anywhere along inner pipe 110 between vessel 106 and drill bit 120.

In some embodiments, bypass valve 124 is included in the drilling system. Bypass valve 124 is shown as a spring activated flap valve, but any type of pressure relief/bypass valve may be used. In operation, bypass valve 124 may be activated when drill bit 120 is locked against formation and unable to rotate due to suction in inner pipe 110. When a given pressure differential (between inside inner pipe 110 and outside inner pipe 110) is reached indicating such a locked position, valve 124 opens allowing drill bit 120 to rotate and further advance. After a small advance of drill bit 120, the pressure differential will decrease, and valve 124 will close. Valve 124 will flutter open and closed as needed to keep drill bit rotating. Valve 124 may maintain a pressure differential from about 1 to about 200 bars, for example from about 5 to about 100 bars, or from about 10 to about 50 bars.

Figure 2:
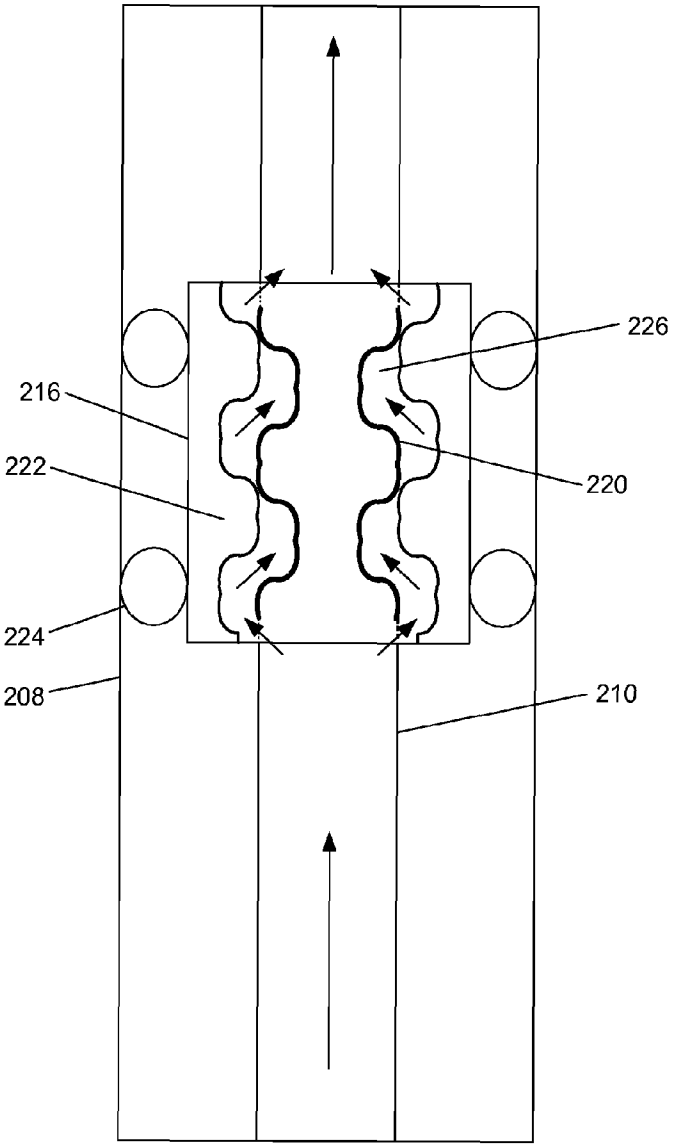
FIG. 2 illustrates a progressive cavity pump.

Referring now to FIG. 2, in some embodiments, a pump 216 is illustrated. The pump 216 is within outer pipe 208, and connected to inner pipe 210. The pump 216 includes a helical rotor 220, which rotates with the inner pipe 210, and a helical stator 222, which is adapted to remain stationary with the outer pipe. Helical stator 222 is connected to outer pipe 208 by one or more brackets, wheels, rollers, and/or inflatable bladders 224. Helical rotor 220 and helical stator 222 define one or more progressive cavities 226, which are adapted to advance a fluid through the pump 216 as shown by the arrows. In some embodiments, pump 216 is a progressive cavity pump.

In operation, fluid leaves inner pipe 210 at the lower end of pump 216, to enter stator 222. Fluid is moved by progressive cavities 226 to the upper end of pump 216, at which point it reenters inner pipe 210. Inner pipe 210 may be provided with perforations at the upper and lower ends.

In some embodiments, pump 216 is a progressive cavity pump as disclosed by Moineau in U.S. Pat. No. 2,028,407, which is herein incorporated by reference in its entirety. In some embodiments, pump 216 is a progressive cavity pump as disclosed by Underwood in U.S. Pat. No. 5,171,139, which is herein incorporated by reference in its entirety. In some embodiments, a suitable progressive cavity pump is commercially available from Moyno, Inc. of Springfield, Ohio. In some embodiments, a suitable progressive cavity pump is commercially available from Monoflo, Inc. of Houston, Tex.

Figure 3:
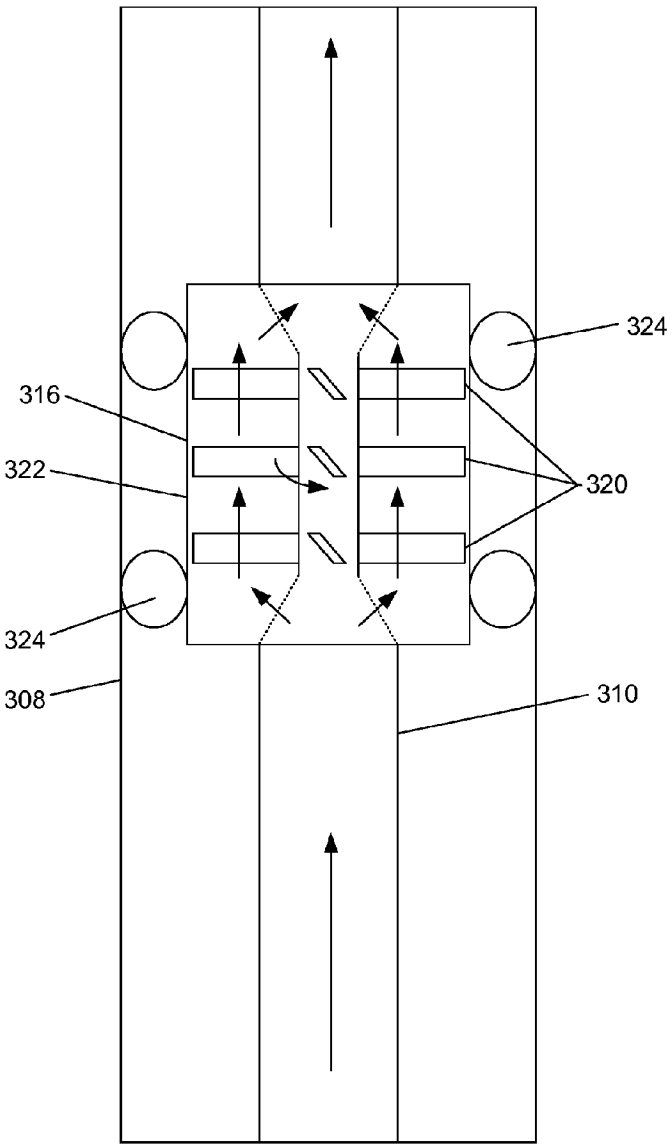
FIG. 3 illustrates a turbine pump.

Referring now to FIG. 3, in some embodiments, a pump 316 is illustrated. The pump 316 is within outer pipe 308, and connected to inner pipe 310. The pump 316 includes one or more sets of impellers 320, which rotate with the inner pipe 310, and a helical stator 322, which is adapted to remain stationary with the outer pipe. Stator 322 is connected to outer pipe 308 by one or more brackets, wheels, rollers, and/or bladders 324. Impellers 320 rotate relative to stator 322 to advance a fluid through the pump 316 as shown by the arrows. In some embodiments, pump 316 is a turbine.

In operation, fluid leaves inner pipe 310 at the lower end of pump 316, to enter stator 322. Fluid is moved by impellers 320 to the upper end of pump 316, at which point it reenters inner pipe 310. Inner pipe 310 may be provided with perforations at the upper and lower ends.

Figure 4:
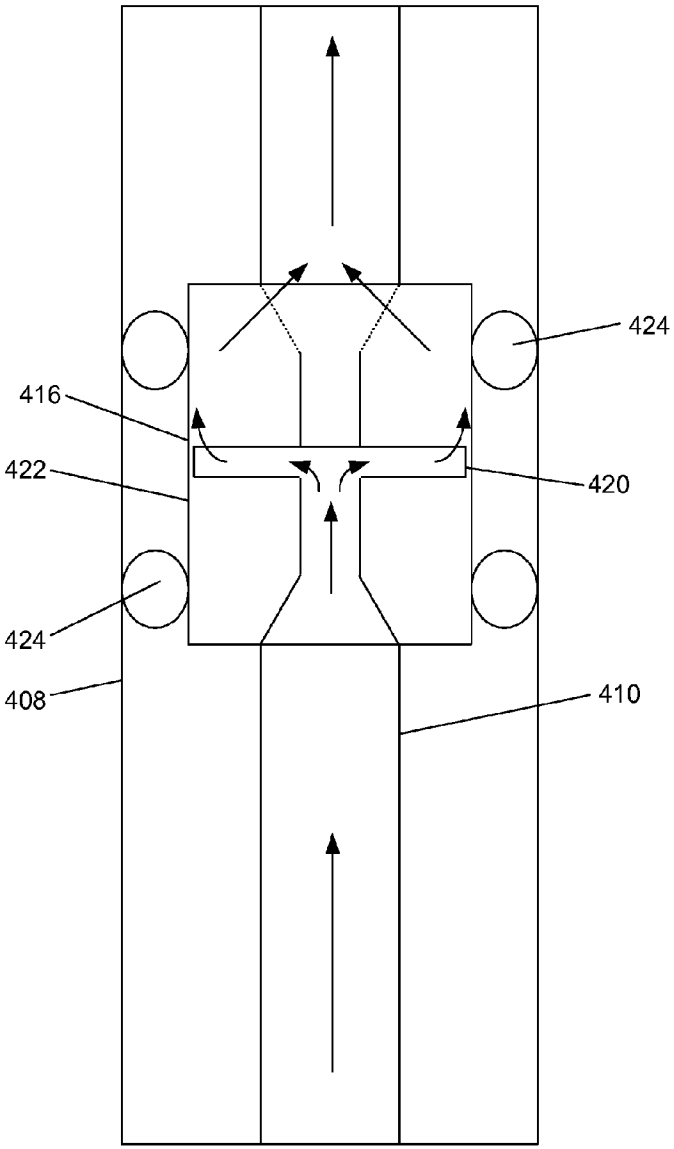
FIG. 4 illustrates a centrifugal pump.

Referring now to FIG. 4, in some embodiments, a pump 416 is illustrated. The pump 416 is within outer pipe 408, and connected to inner pipe 410. The pump 416 includes centrifugal impeller 420, which rotates with the inner pipe 410, and a helical stator 422, which is adapted to remain stationary with the outer pipe. Stator 422 is connected to outer pipe 408 by one or more brackets, wheels, rollers, and/or bladders 424. Centrifugal impeller 420 rotates relative to stator 422 to advance a fluid through the pump 416 as shown by the arrows. In some embodiments, pump 416 is a centrifugal pump.

In operation, fluid flows up inner pipe 410 at the lower end of pump 416, to enter centrifugal impeller 420. The centrifugal force moves the fluid outwards towards outer pipe 408, to the upper end of pump 416, at which point it reenters inner pipe 410. Inner pipe 410 may be provided with perforations at the upper end.

Figure 5:
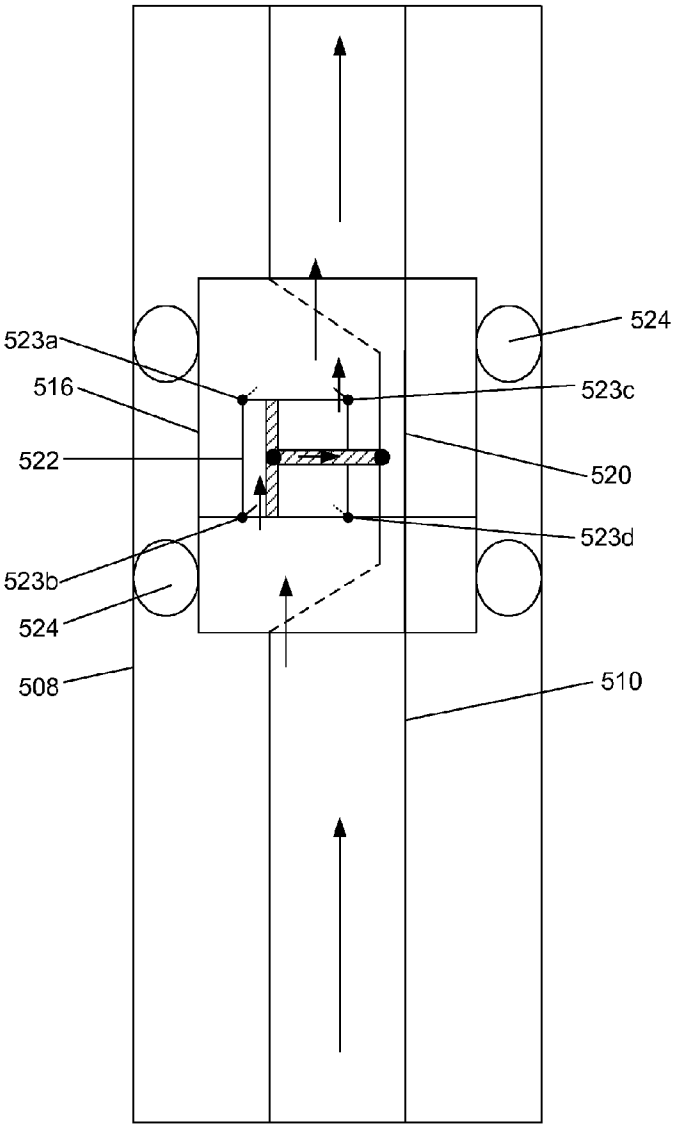
FIG. 5 illustrates a piston pump.

Referring now to FIG. 5, in some embodiments, a pump 516 is illustrated. The pump 516 is within outer pipe 508, and connected to inner pipe 510. The pump 516 includes piston 520, which is rotatably coupled to inner pipe 510, housed within cylinder 522, which piston 520 and cylinder 522 are adapted to remain rotationally stationary with the outer pipe. Cylinder 522 is provided with valves 523*a*-523*d*. Pump 516 may be connected to outer pipe 508 by one or more brackets, wheels, rollers, and/or bladders 524. Piston 520 moves back and forth within cylinder 522 to advance a fluid through the pump 516 as shown by the arrows.

In operation, fluid flows up inner pipe 510 into the lower end of pump 516, to enter cylinder 522 through valve 523*b* or 523*d*. Piston 520 forces fluid out of cylinder 522 through valve 523*a* or 523*c*, to the upper end of pump 516, at which point it reenters inner pipe 510. Inner pipe 510 may be provided with perforations at the lower and upper ends.

When piston 520 is moving in the direction of the arrow, valve 523*b* is open and liquid is entering the left portion of the cylinder 522, and valve 523*d* is closed. Valve 523*c* is open and fluid is leaving the right portion of the cylinder 522, and valve 523*a* is closed.

When piston 520 is moving in the reverse stroke, opposite the direction of the arrow, valve 523*b* is closed and liquid is leaving the left portion of the cylinder 522 through valve 523*d*, which is open. Valve 523*c* is closed and fluid is entering the right portion of the cylinder 522 through valve 523*a*, which is open. In some embodiments, piston 520 may be replaced by one or more longitudinally positioned pistons driven by a swash plate.

Figure 6:
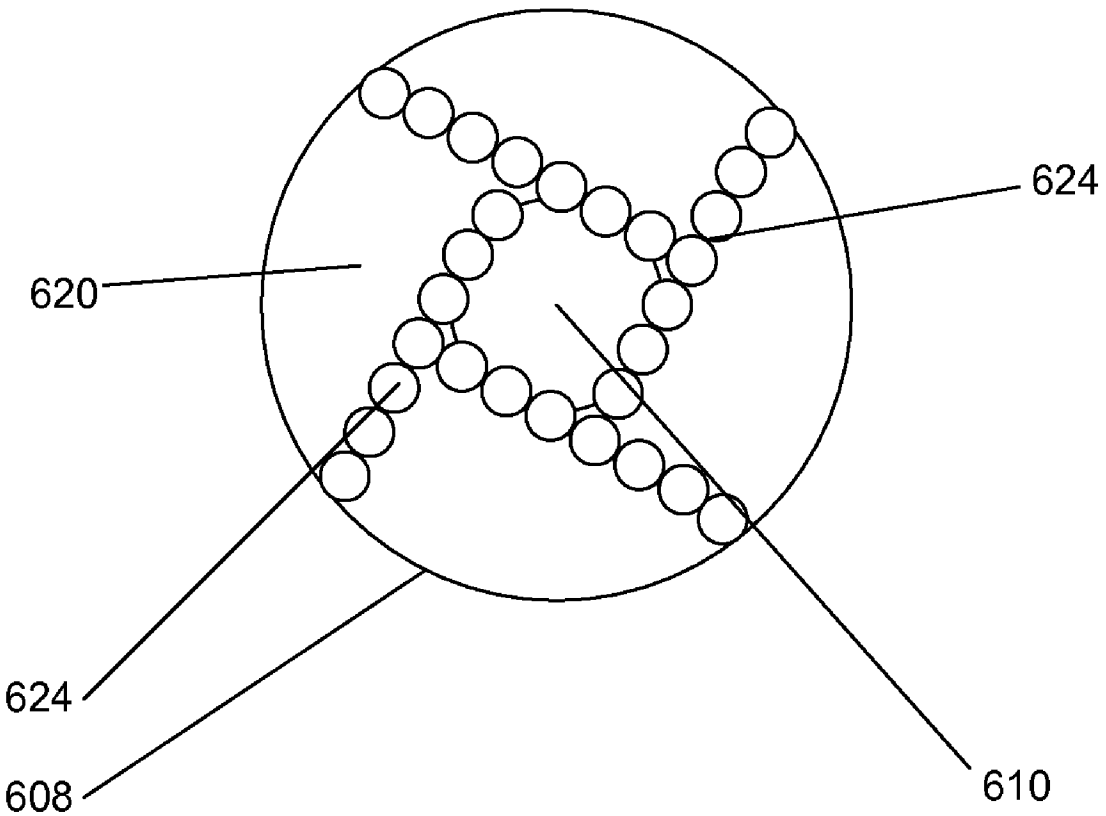
FIG. 6 illustrates a drill bit.

Referring now to FIG. 6, in some embodiments, a bottom view of drill bit 620 is provided. Drill bit 620 has an outside perimeter 608. Drill bit 620 has an inner opening 610, adapted to receive fluids and/or cuttings. Drill bit 620 has cutting elements 624, such as steel, carbide, diamond, synthetic diamond, or other cutting elements as are known in the art.

Figure 7:
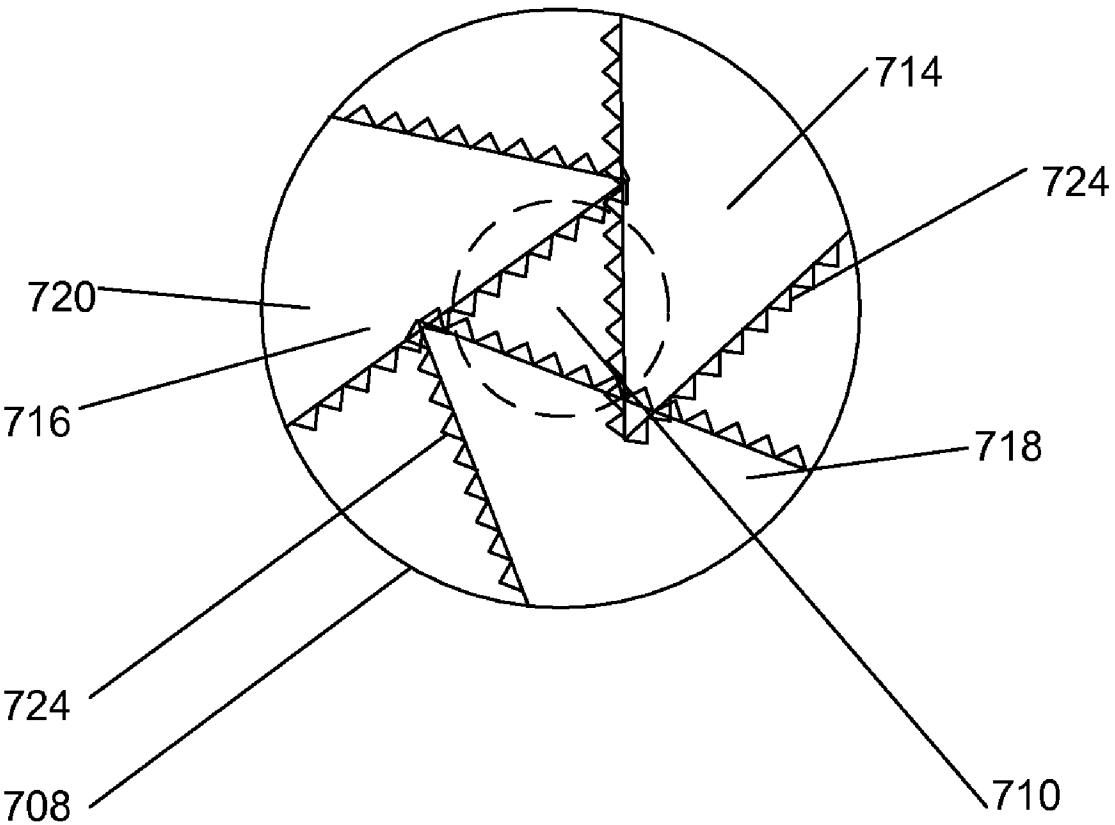
FIG. 7 illustrates a drill bit.

Referring now to FIG. 7, in some embodiments, a bottom view of drill bit 720 is provided. Drill bit 720 has an outside perimeter 708. Drill bit 720 has an inner opening 710, adapted to receive fluids and/or cuttings. Drill bit 720 has cutting elements 724, such as steel, carbide, diamond, synthetic diamond, or other cutting elements as are known in the art. Cutting elements are mounted on one or more of cone 714, cone 716, and cone 718, which may be adapted to rotate as is known in the art. In some embodiments, suitable drill bits can be PDC, diamond, roller cone, or cone barrel drill bits.

In some embodiments, although drilling system 100 is shown in a body of water 102, system can also be used on land, from a swamp barge, from a fixed platform, from a tension leg platform, from an ice floe, or in other environments where drilling is needed.

In some embodiments, drilling system 100 may be particularly advantageous in certain environments with low pressure and/or velocity requirements, for example in shallow sediments with low compressive strength, in shallow water flow, in depleted zones, in thicker zones or stacked reservoirs where the pressure gradient of the fluid in situe is significantly lower than the pressure required to balance formation pressure using a column from surface, in heavy oil where the undisturbed strength of the formation can be largely due to the oil/sand interaction, in fragile sands, for lower annular velocities, for lower pressure surges, in salt formations, such as Magnesium salt which may be susceptible to washouts, in coal bed methane, in methane (condensate) in shallow sediments, where enhanced geological sampling is required, for sampling for gas or liquids in the formation, for sampling geological cuttings, for underbalanced drilling, for pressurized mud cap drilling, for shallow drilling on land to avoid using a stove pipe, below a severe lost circulation zone, for underbalanced drilling of hard rock for penetration rate, and/or on floaters without a riser, if the pump is in the casing which has already been set.

In some embodiments, the circulating fluid can be a gas, e.g. a hydrocarbon gas, an inert gas such as nitrogen, and/or carbon dioxide, for example to be used in very depleted conditions. In some embodiments, the circulating fluid can be a foam, or a mist. In some embodiments, the circulating fluid can be diesel, crude, or base oil, for example to avoid washout of the oil.

In one embodiment, there is disclosed a drilling system comprising a pipe comprising a first end and a second end; a drill bit near a first end of the pipe, adapted to drill a hole in a formation; a pipe rotator near a second end of the pipe adapted to rotate the pipe; and a pump connected to the pipe between the first end and the second end, the pump adapted to transport a fluid from the first end of the pipe to the second end of the pipe, the pump comprising a first portion adapted to rotate with the pipe and a second portion adapted to remain stationary relative to the pipe. In some embodiments, the system is located in a tubular or a hole, the system further comprising an annulus defined between the tubular or the hole. In some embodiments, the system also includes an anchor in the annulus, the anchor connected to the second portion and attached to the tubular or hole. In some embodiments, the anchor is selected from the group consisting of brackets, wheels, rollers, and inflatable bladders. In some embodiments, the system also includes a bypass valve connecting the annulus with an interior of the first end of the pipe, the valve adapted to open when a pressure differential between the annulus and the interior of the first end of the pipe exceeds a set value. In some embodiments, the set value is from 1 to 200 bars, for example from 5 to 100 bars, or from 10 to 50 bars. In some embodiments, the pump comprises a progressive cavity pump. In some embodiments, the pump comprises a turbine with impellers. In some embodiments, the pump comprises a centrifugal pump. In some embodiments, the pump comprises one or more pistons. In some embodiments, the drill bit comprises a plurality of cutting elements and an inner opening fluidly connected to an interior of the first end of the pipe. In some embodiments, the drill bit comprises a plurality of cutting elements on at least rotary cones and an inner opening fluidly connected to an interior of the first end of the pipe.

In one embodiment, there is disclosed a method of enlarging a hole, comprising mounting a drill bit to a pipe; placing the drill bit and the pipe in the hole; rotating the pipe and drill bit in the hole to enlarge the hole; placing a fluid in an annulus between the hole and the pipe; rotating a portion of a pump with the rotating pipe; and pumping the fluid through the drill bit and through the pipe with the pump. In some embodiments, the method also includes bypassing the drill bit, and pumping the fluid directly from the annulus and through the pipe, when a pressure differential between the annulus and an interior of the pipe exceeds a set value. In some embodiments, the method also includes anchoring at least a portion of the pump to the hole, to keep the anchored portion from rotating.

Those of skill in the art will appreciate that many modifications and variations are possible in terms of the disclosed embodiments of the invention, configurations, materials and methods without departing from their spirit and scope. Accordingly, the scope of the claims appended hereafter and their functional equivalents should not be limited by particular embodiments described and illustrated herein, as these are merely exemplary in nature.

That which is claimed is:

1. A drilling system comprising:

a pipe comprising a first end and a second end;

a drill bit near a first end of the pipe, adapted to drill a hole in a formation;

a pipe rotator near a second end of the pipe adapted to rotate the pipe; and a pump connected to the pipe between the first end and the second end, the pump adapted to transport a fluid through the pipe from the first end of the pipe to the second end of the pipe, the pump comprising a first portion adapted to rotate with the pipe and a second portion adapted to remain stationary relative to the pipe.

2. The drilling system of claim 1, wherein the system is located in a tubular or a hole, the system further comprising an annulus defined between the pipe and the tubular or the hole.

3. The drilling system of claim 2, further comprising an anchor in the annulus, the anchor connected to the second portion and attached to the tubular or hole.

4. The drilling system of claim 3, wherein the anchor is selected from the group consisting of brackets, wheels, rollers, and inflatable bladders.

5. The drilling system of claim 2, further comprising a bypass valve connecting the annulus with an interior of the first end of the pipe, the valve adapted to open when a pressure differential between the annulus and the interior of the first end of the pipe exceeds a set value.

6. The drilling system of claim 5, wherein the set value is from 1 to 200 bars.

7. The drilling system of claim 1, wherein the pump comprises a progressive cavity pump.

8. The drilling system of claim 1, wherein the pump comprises a turbine with impellers.

9. The drilling system of claim 1, wherein the pump comprises a centrifugal pump.

10. The drilling system of claim 1, wherein the pump comprises one or more pistons.

11. The drilling system of claim 1, wherein the drill bit comprises a plurality of cutting elements and an inner opening fluidly connected to an interior of the first end of the pipe.

12. The drilling system of claim 1, wherein the drill bit comprises a plurality of cutting elements on at least rotary cones and an inner opening fluidly connected to an interior of the first end of the pipe.

13. A method of enlarging a hole, comprising:

mounting a drill bit to a pipe;

placing the drill bit and the pipe in the hole;

rotating the pipe and drill bit in the hole to enlarge the hole;

placing a fluid in an annulus between the hole and the pipe;

rotating a portion of a pump with the rotating pipe; and pumping the fluid through the drill bit and through the pipe with the pump.

14. The method of claim 13, further comprising:

bypassing the drill bit, and pumping the fluid directly from the annulus and through the pipe, when a pressure differential between the annulus and an interior of the pipe exceeds a set value.

15. The method of claim 13, further comprising:

anchoring at least a portion of the pump to the hole, to keep the anchored portion from rotating.

* * * * *